US008867975B2

(12) United States Patent
Moriguchi

(10) Patent No.: US 8,867,975 B2
(45) Date of Patent: Oct. 21, 2014

(54) FIXING UNIT AND IMAGE FORMING APPARATUS

(75) Inventor: Motoki Moriguchi, Osaka (JP)

(73) Assignee: Kyocera Document Solutions Inc., Osaka-shi (JP)

( * ) Notice: Subject to any disclaimer, the term of this patent is extended or adjusted under 35 U.S.C. 154(b) by 201 days.

(21) Appl. No.: 13/480,286

(22) Filed: May 24, 2012

(65) Prior Publication Data

US 2012/0328339 A1 Dec. 27, 2012

(30) Foreign Application Priority Data

Jun. 21, 2011 (JP) ..... 2011-137611

(51) Int. Cl.
*G03G 15/20* (2006.01)

(52) U.S. Cl.
CPC ..... *G03G 15/2053* (2013.01); *G03G 15/2057* (2013.01); *G03G 15/2082* (2013.01)
USPC ..... 399/328; 399/69

(58) Field of Classification Search
CPC ..... G03G 15/2057; G03G 15/2082
USPC ..... 399/69, 328
See application file for complete search history.

(56) References Cited

U.S. PATENT DOCUMENTS

2007/0014601 A1* 1/2007 Yasuda et al. ..... 399/329

FOREIGN PATENT DOCUMENTS

JP 2008122771 A * 5/2008
JP 2009-150972 A 7/2009

OTHER PUBLICATIONS

JP 2008122771 English translation, Baba et al., May 2008.*

* cited by examiner

*Primary Examiner* — David Gray
*Assistant Examiner* — Thomas Giampaolo, II
(74) *Attorney, Agent, or Firm* — Knobbe Martens Olson & Bear LLP

(57) ABSTRACT

A fixing unit includes a heating rotor, a pressure rotor, an induction coil, and a magnetic core portion having a bypass core portion and a magnetic flux shielding member. The induction coil generates a magnetic flux to heat the heating rotor. A Curie point of the bypass core portion is higher than the temperature of the bypass core portion when the temperature of the heating rotor has reached a fixing temperature for fixing of the transfer material, and lower than the temperature of the bypass core portion when the temperature of the heating rotor has reached a heat-resistant temperature. The magnetic flux shielding member is configured about the periphery of the bypass core portion in close proximity or abutment with the bypass core portion.

8 Claims, 11 Drawing Sheets

FIXING UNIT AND IMAGE FORMING APPARATUS

INCORPORATION BY REFERENCE

This application is based on and claims the benefit of priority from Japanese Patent Application No. 2011-137611, filed on 21 Jun. 2011, the content of which is incorporated herein by reference.

BACKGROUND

The present disclosure relates to a fixing unit and an image forming apparatus provided with the same.

Conventionally, considerable attention has been attracted by a fixing unit in an imaging forming apparatus that uses a rotary belt enabling a reduction in the heat capacity. Furthermore, in recent years, considerable attention has been directed to an induction heating method (IH) for high-speed heating or high-efficiency heating.

A fixing unit using an induction heating method may be associated with a technique, for suppressing an excessive increase in the temperature in a region (non-paper passing region, second region) on the outer side of the paper passing region (first region) in which the sheet of paper is conveyed in response to the width (width of the sheet of paper in a direction vertical to the direction of conveyance of the paper: paper passing width) of the sheet of paper (transfer material) that is conveyed (passes) in the fixing unit, in which the heating amount of a heating rotor in the paper passing region and the non-paper passing region is adjusted.

A fixing unit using an induction heating method includes a heating rotor, a pressure rotor, an induction coil generating a magnetic flux for heat generation by a heating rotor, and a magnetic core portion formed from a magnetic material to thereby reduce the magnetic permeability when temperature of the magnetic core portion reaches a Curie point.

A fixing unit provided with a magnetic core portion to reduce the magnetic permeability when the temperature of the magnetic core portion reaches a Curie point as described above reduces the magnetic permeability of the magnetic core portion when the temperature of the magnetic core portion is higher than or equal to the Curie point in the non-paper passing region of the heating rotor in which no passage of paper has caused a temperature increase. In this manner, excessive temperature increase can be suppressed in the heating rotor.

However, in comparison to use of a magnetic flux shielding member or a degaussing coil for reduction or shielding of the magnetic flux generated in the induction coil, the heating rotor of a fixing unit provided with a magnetic core portion formed from a magnetic material to thereby reduce the magnetic permeability when temperature of the magnetic core portion reaches a Curie point may exhibit a temperature increase in a non-paper passing region. Consequently, there is a need for a fixing unit exhibiting enhanced suppression of excessive temperature increase in a heating rotor.

The present disclosure has the object of providing a fixing unit including a magnetic core portion and enabling enhanced suppression of excessive temperature increase in a heating rotor. It is a further object of the present disclosure to provide an image forming apparatus that includes the fixing unit.

SUMMARY

The fixing unit according to the present disclosure includes a heating rotor, a pressure rotor that is disposed facing the heating rotor and that forms a fixing nip with the heating rotor, an induction coil disposed along an outer surface at a predetermined distance from the outer surface of the heating rotor to thereby generate a magnetic flux to heat the heating rotor, and a magnetic core portion including a bypass core portion and a magnetic flux shielding member. A Curie point of the bypass core portion is higher than the temperature of the bypass core portion when the heating rotor has reached a fixing temperature for fixing of a transfer material, and lower than the temperature of the bypass core portion when the heating rotor has reached a heat-resistant temperature. The magnetic flux shielding member is configured about the periphery of the bypass core portion in close proximity or abutment with the bypass core portion.

An image forming apparatus according to the present disclosure includes an image carrier for forming an electrostatic image on a surface thereof, a developing unit for developing the electrostatic image formed on the image carrier as a toner image, and a transfer unit for transferring the toner image formed on the image carrier onto a transfer material, and a fixing unit. The fixing unit includes a heating rotor, a pressure rotor that is disposed facing the heating rotor and that forms a fixing nip with the heating rotor, an induction coil disposed along an outer surface at a predetermined distance from the outer surface of the heating rotor to thereby generate a magnetic flux to heat the heating rotor, and a magnetic core portion including a bypass core portion and a magnetic flux shielding member. The fixing unit is such that a Curie point of the bypass core portion is higher than the temperature of the bypass core portion when the heating rotor has reached a fixing temperature for fixing of the transfer material, and lower than the temperature of the bypass core portion when the heating rotor has reached a heat-resistant temperature. The magnetic flux shielding member is configured about the periphery of the bypass core portion in close proximity or abutment with the bypass core portion.

DETAILED DESCRIPTION

Figure 1:
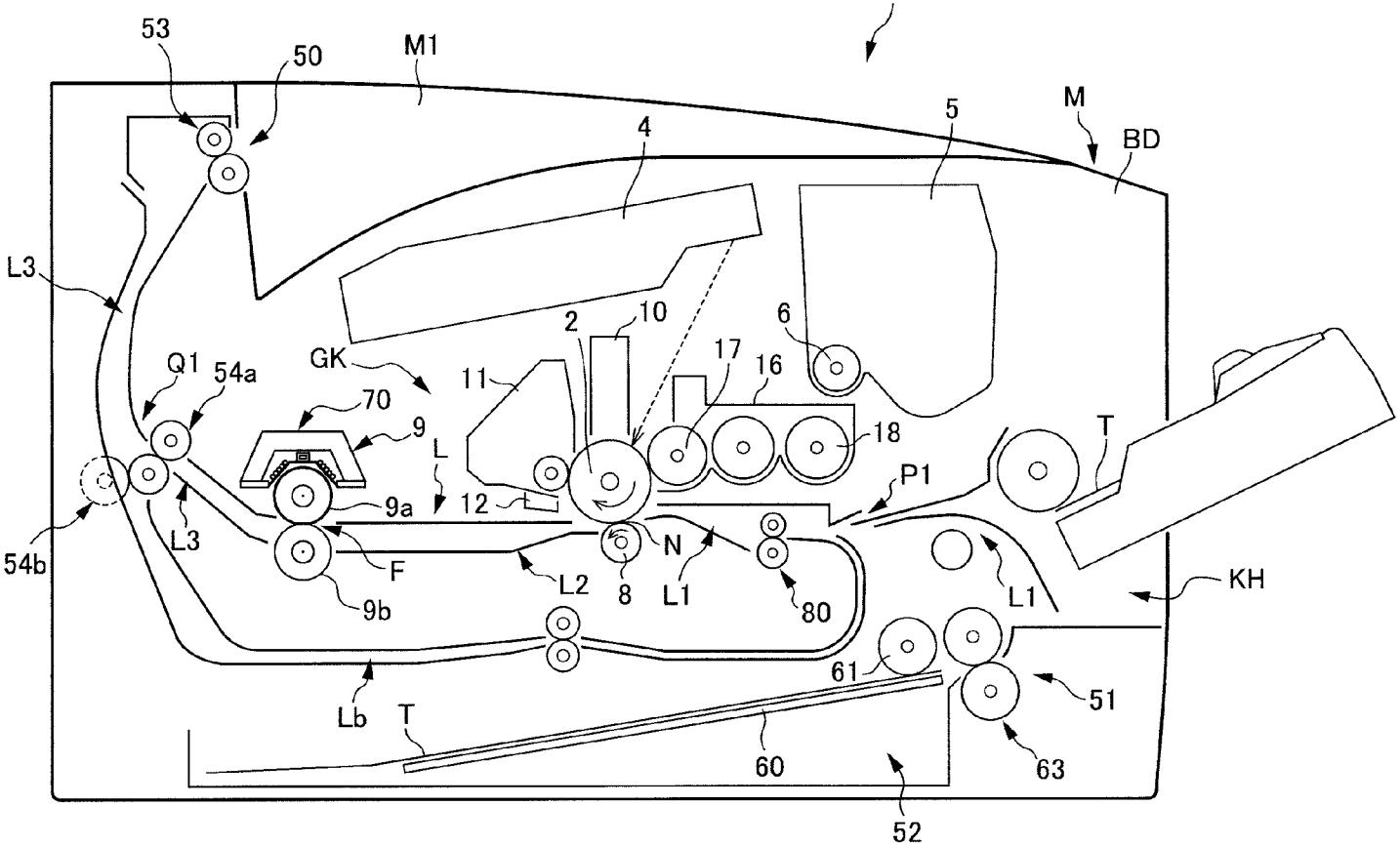
FIG. 1 illustrates the disposition of respective constituent elements in a printer according to a first embodiment of the present disclosure.

The embodiments of the present disclosure will be described below with reference to the figures. FIG. 1 describes the overall structure of a printer 1 as an image forming apparatus according to the first embodiment. FIG. 1 illustrates the disposition of respective constituent elements in the printer 1 according to the first embodiment of the present disclosure.

As illustrated in FIG. 1, the printer 1 according to the first embodiment includes a main body M. The main body M includes a paper feeding/discharging portion KH and an image forming unit GK. The image forming unit GK forms a toner image with reference to image information on the sheet of paper T as a sheet-shaped transfer material. The feeding/discharging portion KH supplies the sheet of paper T to the image forming unit GK and discharges the sheet of paper T having the toner image formed thereon. The outer shape of the main body M is configured by a case BD as a housing.

The image forming unit GK includes a photoreceptor drum 2 as an image carrier (photoreceptor body), a charging unit 10, a laser scanner unit 4 as an exposure unit, a developing unit 16, a toner cartridge 5, a toner supply unit 6, a drum cleaning unit 11, a neutralization unit 12, a transfer roller 8 as a transfer unit, and the fixing unit 9.

The paper feeding/discharging portion KH includes a paper feed cassette 52, a conveyance path L for the sheet of paper T, a pair of registration rollers 80, and a paper discharging unit 50.

Hereafter, the configuration of the image forming unit GK and the paper feeding/discharging portion KH will be described in detail.

Firstly, the image forming unit GK will be described. In the image forming unit GK, in the following order from the upstream side to the downstream side in the rotation direction of the photoreceptor drum 2 as illustrated by the arrow in FIG. 1, charging is performed by the charging unit 10, exposure is performed by the laser scanner unit 4, development is performed by the developing unit 16, transfer is performed by the transfer roller 8, neutralization is performed by the neutralization unit 12, and cleaning is performed by the drum cleaning unit 11.

The photoreceptor drum 2 is a cylindrical member and has the function of a photoreceptor body or an image carrier. The photoreceptor drum 2 is rotatably configured in the direction of the arrow illustrated in FIG. 1, about a rotational axis extending in a direction that is orthogonal to the direction of the conveyance of the sheet of paper T on the conveyance path L. An electrostatic latent image can be formed on a surface of the photoreceptor drum 2.

The charging unit 10 is arranged opposite to the surface of the photoreceptor drum 2. The charging unit 10 negatively charges (negative polarity) or positively charges (positive polarity) the surface of the photoreceptor drum 2 in a uniform manner.

The laser scanner unit 4 functions as an exposure unit, and is separated from the surface of the photoreceptor drum 2.

The laser scanner unit 4 performs scanning exposure of the surface of the photoreceptor drum 2, based on image information supplied from an external device such as a personal computer (PC), or the like to thereby form an electrostatic image on the surface of the photoreceptor drum 2.

The developing unit 16 is provided facing the surface of the photoreceptor drum 2. The developing unit 16 causes a toner of a single color (usually black) to develop the electrostatic latent image formed on the surface of the photoreceptor drum 2, thereby forming a monotone toner image on the surface of the photoreceptor drum 2. The developing unit 16 includes a developing roller 17 arranged opposite to the surface of the photoreceptor drum 2, and an agitation roller 18 for agitating the toner.

The toner cartridge 5 is provided corresponding to the developing unit 16, and stores the toner to be supplied to the developing unit 16.

The toner supply unit 6 is provided corresponding to the toner cartridge 5 and the developing unit 16. The toner supply unit 6 supplies the toner stored in the toner cartridge 5 to the developing unit 16.

The transfer roller 8 transfers a toner image formed on the surface of the photoreceptor drum 2 to the sheet of paper T. The transfer roller 8 can rotate in abutment with the photoreceptor drum 2.

A transfer nip N is formed between the photoreceptor drum 2 and the transfer roller 8. The toner image formed on the photoreceptor drum 2 is transferred to the sheet of paper T in the transfer nip N. The neutralization unit 12 is arranged facing the surface of the photoreceptor drum 2. The drum cleaning unit 11 is arranged facing the surface of the photoreceptor drum 2.

The fixing unit 9 melts and pressurizes the toner forming the toner image that has been transferred to the sheet of paper T, and fixes the toner on the sheet of paper T. The fixing unit 9 will be described in detail below.

Next, the paper feeding/discharging portion KH will be described. The paper feed cassette 52 that stores sheets of paper T is arranged in a lower part of the main body M. A mounting plate 60 for placing sheets of paper T in a stacked configuration is arranged in the paper feed cassette 52. A sheet of paper T placed on the mounting plate 60 is fed to the conveyance path L by a cassette feeder 51. The cassette feeder 51 includes a double-feed prevention mechanism that is composed of a forward feed roller 61, and a pair of feed rollers 63.

The forward feed roller 61 picks up a sheet of paper T from the mounting plate 60. The pair of feed rollers 63 feed the sheet of paper T to the conveyance path L on a sheet by sheet basis.

The paper discharging unit 50 is arranged on the top portion of the main body M. The paper discharging unit 50 discharges a sheet of paper T to an outer portion of the main body M with a third roller pair 53. The paper discharging unit 50 will be described in detail below.

The conveyance path L for conveying the sheet of paper T includes a first conveyance path L1, a second conveyance path L2, a third conveyance path L3 and a return conveyance path Lb. The first conveyance path L1 is a conveyance path from the cassette feeder 51 to the transfer nip N. The second conveyance path L2 is a conveyance path from the transfer nip N to the fixing unit 9. The third conveyance path L3 is a conveyance path from the fixing unit 9 to the paper discharging unit 50. The return conveyance path Lb is a conveyance path that causes a sheet of paper, which is conveyed on the third conveyance path L3 from upstream to downstream, to be turned upside down and conveyed back to the first conveyance path L1.

A first joint portion P1 is formed midway on the first conveyance path L1. A first branch portion Q1 is formed midway on the third conveyance path L3. The first branch portion Q1 is a branch portion at which the return conveyance path Lb branches from the third conveyance path L3. The first branch portion Q1 includes a first roller pair 54*a* and a second roller pair 54*b*. One roller of the first roller pair 54*a* and one roller of the second roller pair 54*b* are used in common.

A paper detection sensor (not illustrated) and the pair of registration rollers 80 are disposed on the first conveyance path L1 (more specifically between the first joint portion P1 and the transfer nip N). The pair of registration rollers 80 is configured to correct skew (diagonal paper feed) of the sheet of paper T and to adjust the timing of feeding the sheet of paper with respect to the formation of a toner image at the image forming unit GK.

The paper discharging unit 50 is formed at an end with reference to the paper conveyance direction of the third conveyance path L3. The paper discharging unit 50 is arranged at an upper part of the main body M. The paper discharging unit 50 discharges the sheet of paper T conveyed on the third conveyance path L3 outside the main body M with the third roller pair 53.

A discharged paper accumulating portion M1 is formed near the opening of the paper discharging unit 50. The discharged paper accumulating portion M1 is formed on a top surface (external surface) of the main body M. Paper detection sensors (not illustrated) are arranged at predetermined locations in the respective conveyance paths.

Figure 2:
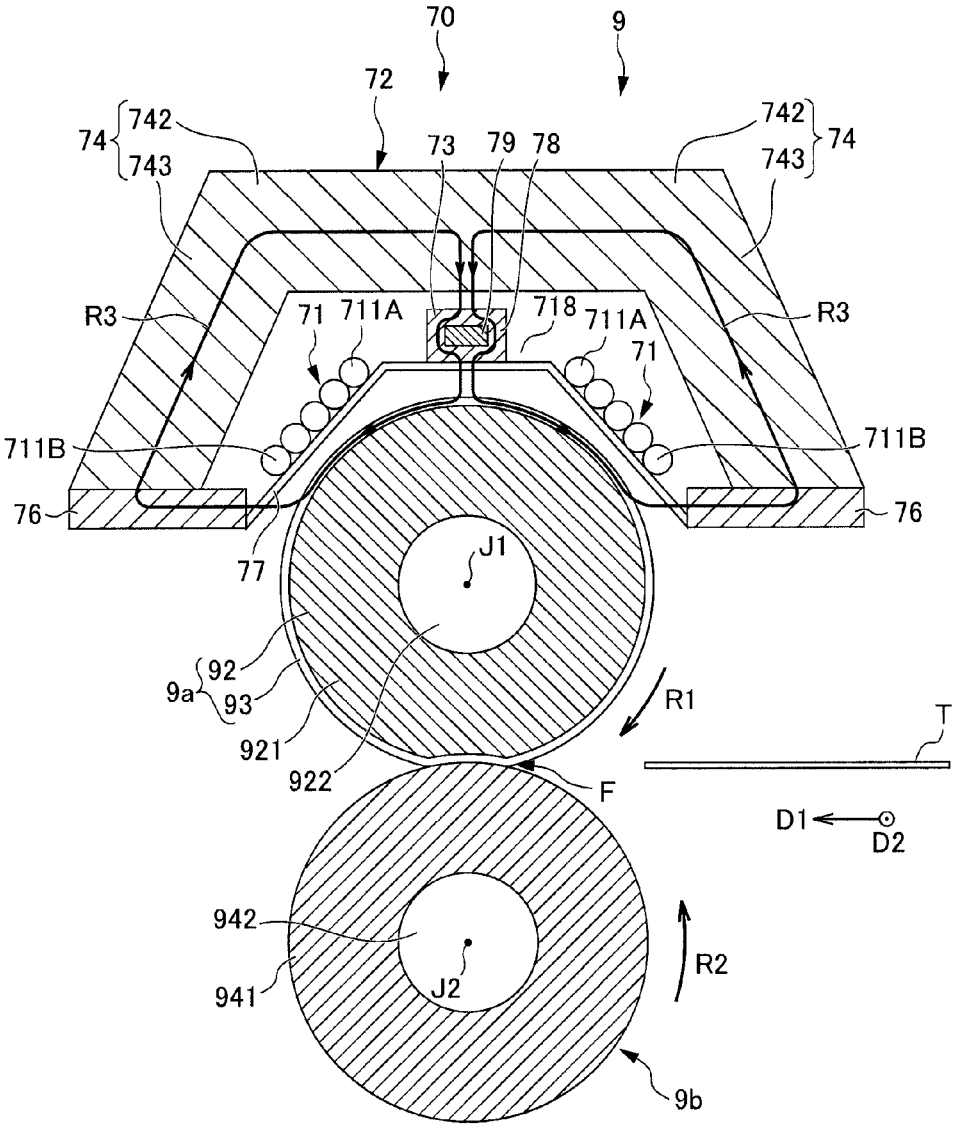
FIG. 2 is a sectional view illustrating the respective constituent elements of a fixing unit in the printer according to the first embodiment.
Figure 3:
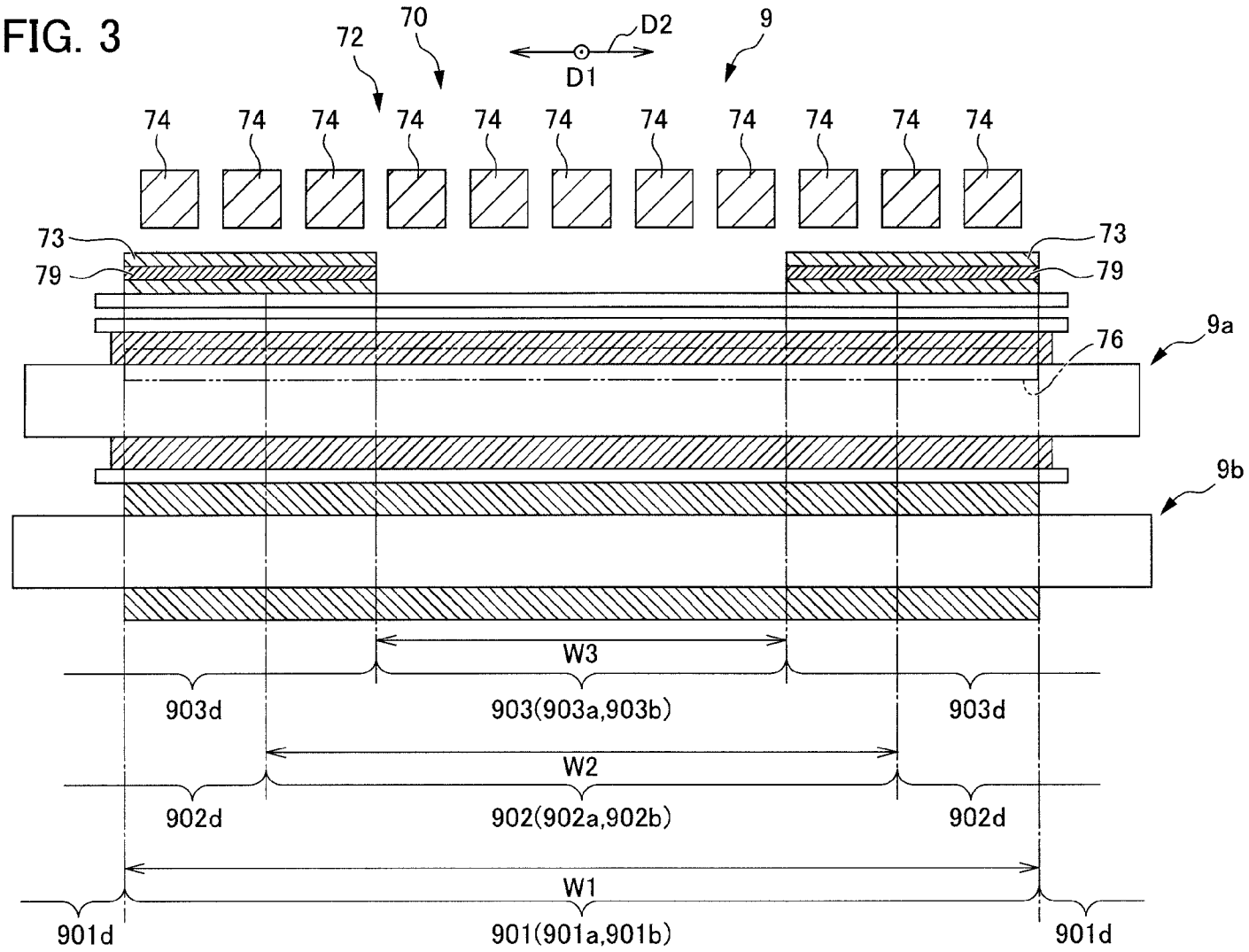
FIG. 3 is a view of the fixing unit illustrated in FIG. 2 as seen from the conveyance direction of a sheet of paper.
Figure 4A:
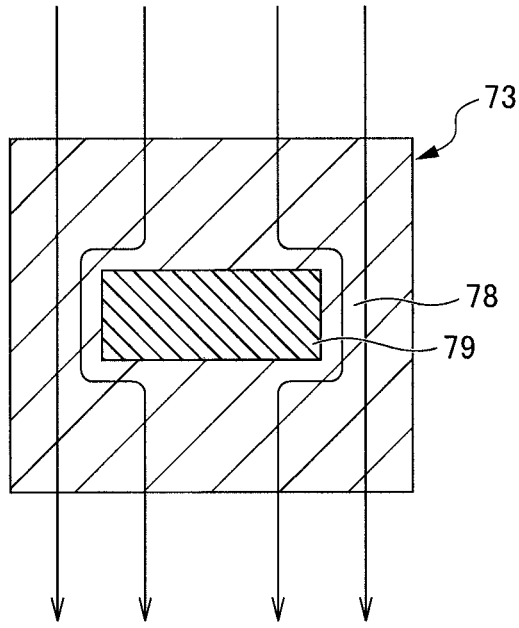
FIG. 4A is a sectional view illustrating a magnetic flux that passes through center core portions when temperatures of the center core portions in the first embodiment have not reached Curie points.
Figure 4B:
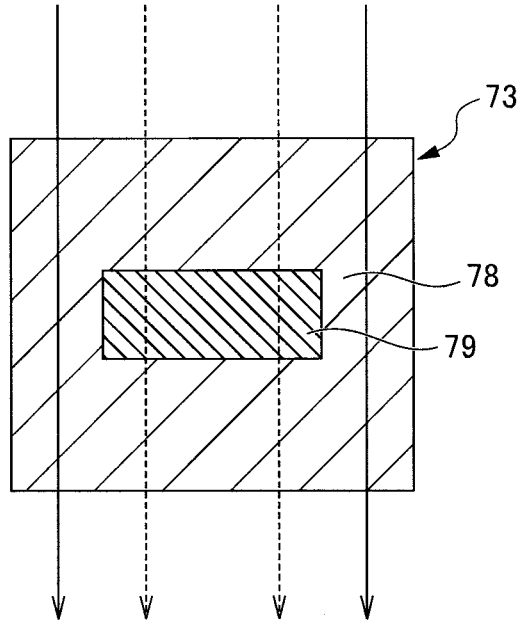
FIG. 4B is a sectional view illustrating the magnetic flux that passes through the center core portions when temperatures of the center core portions in the first embodiment have reached the Curie points.

Next, the configuration of the fixing unit 9 that is the characteristic unit of the printer 1 according to the first embodiment will be described in detail. FIG. 2 is a sectional view illustrating the respective constituent elements of the fixing unit 9 in the printer 1 according to the first embodiment. FIG. 3 is a view of the fixing unit 9 illustrated in FIG. 2 as seen from the conveyance direction D1 of a sheet of paper T. FIG. 4A is a sectional view illustrating a magnetic flux that passes through the center core portions 73 when temperatures of the center core portions 73 in the first embodiment have not reached Curie points. FIG. 4B is a sectional view illustrating the magnetic flux that passes through the center core portions 73 when temperatures of the center core portions 73 in the first embodiment have reached the Curie points. In FIG. 3, the side core portions 76 are illustrated by the alternate long and two short dashes line.

As illustrated in FIG. 2, the fixing unit 9 includes a heating rotor 9*a*, a pressing roller 9*b* as a pressure rotor in pressing contact (abutment) with the heating rotor 9*a*, and a heating unit 70.

The heating rotor 9*a* has an annular shape when viewed from its rotation axis J1. The heating rotor 9*a* can rotate in a first peripheral direction R1. By using the heating unit 70 described below, the heating rotor 9*a* generates heat by induction heating that employs magnetic induction. The heating rotor 9*a* includes a fixing roller 92 and a heating rotary belt 93 that is disposed to cover the outer peripheral surface of a fixing roller 92.

As illustrated in FIG. 2, the fixing roller 92 has a cylindrical shape. The fixing roller 92 can rotate in the first peripheral direction R1 about the first rotation axis J1 that is parallel to the direction D2 that is orthogonal to the first peripheral direction R1. The fixing roller 92 extends in the first rotation axis J1. In the present embodiment, the first rotation direction J1 or the direction that is orthogonal to the tangent to the first peripheral direction R1 is termed the "sheet width direction D2". The sheet width direction D2 substantially corresponds with the first rotation axis J1 direction.

The fixing roller 92 includes a fixing roller main body 921 and axial members 922 coaxial to the first rotation axis J1. The fixing roller main body 921 includes a cylindrical metallic member, and an elastic layer formed on an outer peripheral surface of the metallic member.

The axial members 922 of the fixing roller 92 project respectively from both ends of the fixing roller main body 921 to an outer side in the direction of the first rotation axis J1. The axial members 922 of the fixing roller 92 are rotatably supported on the case of the fixing unit 9 or another member. In this manner, the fixing roller 92 can rotate about the first rotation axis J1.

As illustrated in FIG. 2, the heating rotary belt 93 has a circular (endless belt) shape when viewed from the rotation axis J1. The heating rotary belt 93 can rotate in a first peripheral direction R1. The heating rotary belt 93 is disposed along the outer peripheral surface of the fixing roller 92 to cover the outer peripheral surface of the fixing roller 92. The outer peripheral surface of the fixing roller 92 abuts with the inner peripheral surface of the heating rotary belt 93. The heating rotary belt 93 has heat resistant characteristics.

In the present embodiment, the base of the heating rotary belt 93 is formed from a ferromagnetic material such as nickel, or the like. The heating rotary belt 93 forms a magnetic path for a magnetic flux generated by the induction coil 71 of the heating unit 70 by disposition in a region subjected to passage of the magnetic flux generated by the induction coil 71 of the heating unit 70 described below, and configuration of the base using a ferromagnetic material. The magnetic flux generated by the induction coil 71 passes along (is introduced along) the heating rotary belt 93 forming the magnetic path. The heating rotary belt 93 further includes an elastic layer formed on the outer peripheral surface of the base, and a surface release layer formed on the outer peripheral surface of the elastic layer.

An eddy current (induced current) is generated in the heating rotary belt 93 by electromagnetic induction by a magnetic flux passing through the heating rotary belt 93 that is generated by the induction coil 71 as described below. A Joule heat is generated in the heating rotary belt 93 by electrical resistance of the heating rotary belt 93 to the passage of the eddy current in the heating rotary belt 93.

A pressing roller 9*b* has a cylindrical shape. The pressing roller 9*b* is disposed facing the lower vertical side of the heating rotor 9*a* and facing the fixing roller 92. The pressing roller 9*b* can rotate in the second peripheral direction R2 about the second rotation axis J2 that is parallel to the sheet width direction D2. The pressing roller 9*b* extends in the second rotation axis J2 direction.

The outer peripheral surface of the pressing roller 9*b* is disposed to abut with the outer peripheral surface (external surface) of the heating rotary belt 93. The pressing roller 9*b* is disposed to press the fixing roller 92 though the heating rotary belt 93. The pressing roller 9*b* sandwiches a portion of the heating rotary belt 93 with the fixing roller 92 to thereby form a fixing nip F with the heating rotary belt 93. The sheet of paper T is sandwiched and conveyed at the fixing nip F.

The pressing roller 9*b* includes a pressing roller main body 941 and axial members 942 coaxial to the second rotation axis J2. The pressing roller main body 941 includes a cylindrical metallic member, an elastic layer formed on an outer peripheral surface of the metallic member, and a release layer formed on an outer peripheral surface of the elastic layer.

A rotation drive unit (not illustrated) for driving to rotate the pressing roller 9*b* is connected to one of the axial members 942 of the pressing roller 9*b*. The pressing roller 9*b* is driven to rotate at a predetermined speed in the second peripheral direction R2 by the rotation drive unit. The heating rotary belt 93 in abutment with the outer peripheral surface of the pressing roller 9*b* is rotated in response to the rotation of the pressing roller 9*b*. When the heating rotary belt 93 is rotated, the fixing roller 92 in abutment with the inner peripheral surface of the heating rotary belt 93 is rotated in response to the rotation of the heating rotary belt 93.

A toner image is fixed when the sheet of paper T conveyed to the fixing nip F is conveyed and passes through the paper passing region (first region) of the fixing unit 9. As used herein "paper passing region" (first region) is the region through which a sheet of paper T conveyed to the fixing nip F passes in a configuration of being sandwiched by the heating rotary belt 93 and the pressing roller 9*b* when the sheet of paper T is conveyed to the fixing nip F. Furthermore, the region on the outer side of the sheet width direction D2 seen from the paper passing region through which the sheet of paper T does not pass is termed the "non-paper passing region" (second region). The non-paper passing region is formed in response to a sheet of paper T having a plurality of sizes.

As illustrated in FIG. 3, a maximum paper passing region 901 is set as a paper passing region through which a sheet of paper T corresponding to the maximum length of the sheet width direction D2 (maximum width) passes when the sheet of paper T is conveyed to the fixing nip F. The maximum paper passing region 901 is respectively set in relation to each printer 1. The region on the outer side of the sheet width direction D2 of the maximum paper passing region 901 is the maximum non-paper passing region 901*d*.

More specifically, a heating-side maximum paper passing region 901*a* is formed (set) as the maximum paper passing region 901 of the heating rotary belt 93 on the outer peripheral surface of the heating rotary belt 93. A pressing-side maximum paper passing region 901*b* is formed (set) as the maximum paper passing region 901 of the pressure rotor 9*b* on the outer peripheral surface of the pressing roller 9*b* to correspond with the heating-side maximum paper passing region 901*a* of the heating rotary belt 93. The length in a direction parallel to the sheet width direction D2 of the heating-side maximum paper passing region 901*a* is termed the "maximum paper passing width W1".

A minimum paper passing region 903 is set as a paper passing region through which a sheet of paper T corresponding to the minimum length of the sheet width direction D2 (minimum width) is conveyed to the fixing nip F. The region on an outer side of the sheet width direction D2 of the minimum paper passing region 903 is the minimum non-paper passing region 903*d*.

More specifically, a heating-side minimum paper passing region 903*a* is formed (set) as the minimum paper passing region 903 of the heating rotary belt 93 on the outer peripheral surface of the heating rotary belt 93. A pressing-side minimum paper passing region 903*b* is formed (set) on the outer peripheral surface of the pressing roller 9*b* to correspond with the heating-side minimum paper passing region 903*a* of the heating rotary belt 93. The length in a direction parallel to the sheet width direction D2 of the heating-side minimum paper passing region 903*a* is termed the "minimum paper passing width W3".

An intermediate paper passing region 902 (heating-side intermediate paper passing region 902*a* and pressing-side intermediate paper passing region 902*b*) is set as a paper passing region through which a sheet of paper T that has a length in the sheet width direction D2 corresponding to an intermediate length that is shorter than the maximum length and longer than the minimum length (intermediate width) passes when the sheet of paper T is conveyed to the fixing nip F in the fixing unit 9 according to the present embodiment. The region on an outer side of the sheet width direction D2 of the intermediate paper passing region 902 is the intermediate non-paper passing region 902*d*. The length in a direction parallel to the sheet width direction D2 of the heating-side intermediate paper passing region 902*a* is termed the "intermediate paper passing width W2". The paper passing regions for the sheets of paper T are not limited thereby and may be suitably set corresponding to the size of the sheets of paper T.

Next, the heating unit 70 will be described. As illustrated in FIG. 2 and FIG. 3, the heating unit 70 includes the induction coil 71 and a magnetic core portion 72. The induction coil 71 is separated from the outer peripheral surface of the heating rotary belt 93 by a predetermined distance, and is disposed along the outer peripheral surface of the heating rotary belt 93. In the present embodiment, the induction coil 71 has a pre-wound configuration. The induction coil 71 is disposed on the heating unit 70 so that a longitudinal direction thereof is parallel to the sheet width direction D2. The induction coil 71 may be formed by winding wire in an elongated configuration with reference to the sheet width direction D2 viewed in plan (when seen from above FIG. 2 and FIG. 3).

The induction coil 71 is formed to be longer than the length of the heating rotary belt 93 in the sheet width direction D2. The induction coil 71 is disposed facing the outer peripheral surface of substantially the upper half periphery in the vertical direction of the heating rotary belt 93. The induction coil 71 is disposed about the central region 718 extending in the sheet width direction D2. The central region 718 is a region elongated in the sheet width direction D2 on which the wires of the induction coil 71 are not disposed on an upper side of a portion positioned uppermost in a vertical direction of the heating rotary belt 93 (approximately the center in the conveyance direction D1).

The induction coil 71 has the configuration described below when the induction coil 71 is disposed in the heating unit 70. In other words, the inner peripheral edge of the induction coil 71 (the position at which the wire 711A is disposed) encloses the central region 718. The wire configuring the induction coil 71 extends in the sheet width direction D2. Furthermore, the wire configuring the induction coil 71 is aligned from the inner peripheral edge of the induction coil 71 in the peripheral direction of the heating rotary belt 93. The outer peripheral edge of the induction coil 71 (the position at which the wire 711B is disposed) faces the outer peripheral surface of the heating rotary belt 93. In the present embodiment, the induction coil 71 is fixed onto a support member 77 formed from a heat-resistant resin material.

The induction coil 71 is connected to an induction heating circuit (not shown). An alternating current is applied from the induction heating circuit to the induction coil 71. The induction coil 71 generates a magnetic flux to generate heat in the heating rotary belt 93 by application of the alternating current from the induction heating circuit. For example, an alternating current of substantially a 30 kHz frequency is applied to the induction coil 71.

The magnetic flux generated by the induction coil 71 is guided to a magnetic path for the magnetic flux formed from the heating rotary belt 93 and the magnetic core portion 72 (described below).

The magnetic path is formed by the magnetic core portion 72 (described below) and the heating rotary belt 93 so that the magnetic flux generated by the induction coil 71 revolves in a revolving direction R3. The revolving direction R3 is a direction passing along the inner side of the inner peripheral edge 711A and the outer side of the outer peripheral edge 711B of the induction coil 71 to thereby revolve about a portion of the wire of the induction coil 71. The magnetic flux generated by the induction coil 71 passes through the magnetic path.

The magnetic flux generated by the induction coil 71 changes both its intensity and direction due to positive or negative periodic fluctuation of the alternating current since an alternating current is applied from the induction heating circuit (not illustrated). An induction current (eddy current) is generated in the heating rotary belt 93 by changes in the magnetic flux.

The magnetic core portion 72 configures a magnetic path that revolves in the revolving direction R3 as illustrated in FIG. 2. The magnetic core portion 72 is disposed in a region through which the magnetic flux generated by the induction coil 71 passes and is mainly formed from a ferromagnetic material. As a result, the magnetic core portion 72 forms a magnetic path that is a path for magnetic flux generated by the induction coil 71.

The magnetic core portion 72 includes center core portions 73 as a first core portion, a pair of side core portions 76, and a plurality of arch core portions 74 as a second core portion. The main body of the center core portions 73, the arch core portions 74 and the side core portions 76 are configured for example using a magnetic core formed by sintering ferrite powder which is a ferromagnetic material.

The Curie points of the center core portions 73, the arch core portions 74 and the side core portions 76 is set to temperatures higher than the temperature of the core portion when the heating rotary belt 93 (fixing unit 9) has reached a fixing temperature for fixing of the sheet of paper T, and lower than the temperature of the core portion when the heating rotor 9*a* (heating rotary belt 93) has reached a heat-resistant temperature. More specifically, if it is assumed that the fixing temperature of the heating rotary belt 93 (the temperature at which toner can be fixed to the sheet of paper T) is 160 degrees C., the temperature of the magnetic core portion 72 (center core portions 73) will be 120 degrees C. when the heating rotary belt 93 has reached the fixing temperature (160 degrees C.). The heat-resistant temperature of the heating rotary belt 93 is 240 degrees C. When the temperature of the heating rotary belt 93 exceeds the heat-resistant temperature (240 degrees C.), the flexibility of the elastic layer configuring the heating rotary belt 93 may be reduced, and the elastic layer configuring the heating rotary belt 93 may peel from the base layer of the heating rotary belt 93, and the possibility of fracture may be increased. The temperature of the magnetic core portion 72 (center core portions 73) is 190 degrees C. when the heating rotary belt 93 is at the heat resistant temperature (240 degrees C.). Therefore, the Curie point of the magnetic core portion 72 (center core portions 73) is set to a temperature between 120 degrees C. and 190 degrees C. For example, in the present embodiment, the Curie point of the magnetic core portion 72 (center core portions 73) is set 160 degrees C.

When the Curie points of the center core portions 73, the arch core portions 74 and the side core portions 76 are higher than the temperature of the core portions when temperature of the heating rotary belt 93 has reached the fixing temperature, during warm-up, the temperature of the center core portions 73, the arch core portions 74 and the side core portions 76 do not reach Curie points until the temperature of the heating rotor 9*a* reaches the fixing temperature. In this manner, before the center core portions 73, the arch core portions 74 and the side core portions 76 reach the Curie points, the temperature of the heating rotor 9*a* can rapidly increase to the fixing temperature.

When the Curie points of the center core portions 73, the arch core portions 74 and the side core portions 76 is lower than the temperature of the core portion when temperature of the heating rotor 9*a* has reached the heat-resistant temperature, before the temperature of the heating rotor reaches the heat resistant temperature, the temperatures of the center core portions 73, the arch core portions 74 and the side core portions 76 reach the Curie points. Consequently, the functions of inducing the magnetic flux of the center core portions 73, the arch core portions 74 and the side core portions 76 are lost. In this manner, suppression of an excessive temperature increase in the heating rotor 9*a* can be ensured prior to the heating rotor 9*a* reaching the heat-resistant temperature.

The Curie point for each core portion for example can be suitably set by selection of the composition of the ferrite powder when forming the magnetic core.

As illustrated in FIG. 2, when viewed in the sheet width direction D2, the center core portions 73 as the first core portions are disposed in a substantially center position with reference to the conveyance direction D1 of the sheet of paper T on an upper side in the vertical direction of the heating rotor 9*a*. That is to say, the center core portions 73 are disposed in a central region 718.

When viewed in the sheet width direction D2, the center core portions 73 are disposed between the arch core portions 74 described below and the heating rotor 9*a*. The center core portions 73 are configured from a separate body to the arch core portions 74 described below. The center core portions 73 are separated from the outer peripheral surface of the heating rotor 9*a* by a predetermined distance without sandwiching the induction coil 71 therebetween. The lower surface of the center core portions 73 faces the outer peripheral surface of the upper side of the heating rotor 9*a*. The center core portions 73 are disposed closer to the heating rotor 9*a* than the arch core portions 74 described below in proximity to the inner peripheral edge 711A of the induction coil 71.

As illustrated in FIG. 3, the center core portions 73 extend in the sheet width direction D2 in a minimum non-paper passing region 903*d*. The center core portions 73 are formed in substantially a rectangular parallelepiped shape that is elongated with respect to the sheet width direction D2. The center core portions 73 are set to have a smaller heat capacity than the arch core portions 74 by forming a smaller volume in comparison to the arch core portions 74 described below.

As illustrated in FIG. 2, the center core portions 73 forms a magnetic path between the arch core portions 74 and the heating rotor 9*a* in the revolving direction R3 of the magnetic path.

In the present embodiment, the center core portions 73 are fixed onto the supporting member 77.

The magnetic core portion 72 includes bypass core portions 78 and magnetic flux shielding members 79. The bypass core portions 78 forms parts of the center core portions 73. The magnetic flux shielding members 79 are disposed on the inner portions of the center core portions 73.

As illustrated in FIG. 2, when viewed in the sheet width direction D2, the magnetic flux shielding members 79 are disposed in substantially the center of the center core portions 73. The magnetic flux shielding members 79 are disposed in proximity to or abutment with the bypass core portions 78 described below in the inner portions of the center core portions 73. The magnetic flux shielding members 79 are disposed about the periphery of the bypass core portions 78 described below on the inner portions of the center core portions 73. When the bypass core portions 78 do not have the functions of inducing magnetic flux, the magnetic flux shielding members 79 are disposed at a position of passage of at least a portion of the magnetic flux generated by the induction coil 71.

The magnetic flux shielding members 79 are formed in substantially rectangular parallelepiped shapes that are elongated with respect to the sheet width direction D2. As illustrated in FIG. 3, when viewed from the conveyance direction D1 of the sheet of paper T, the magnetic flux shielding member 79 extend in the sheet width direction D2 in the minimum non-paper passing region 903*d* on an outer side of the minimum paper passing region 903 on the inner portions of the center core portions 73 in the same manner as the center core portions 73.

Each of the magnetic flux shielding members 79 is formed from a member that is non-magnetic and has high conductivity. Oxygen-free copper for example is used as the magnetic flux shielding members 79.

The bypass core portions 78 are a portion of the periphery of the magnetic flux shielding members 79 on an outer side of the magnetic flux shielding members 79 in the center core portions 73. In other words, the bypass core portions 78 are portions where ferromagnetic material continue to avoid the magnetic flux shielding members 79 in the inner portions of the center core portions 73.

When temperatures of the bypass core portions 78 do not reach Curie points, the bypass core portions 78 bypass (allows passage of) magnetic flux to avoid the magnetic flux shielding members 79 by reason of a function of introducing the magnetic flux generated by the induction coil 71. Since the magnetic flux avoids the magnetic flux shielding members 79 and passes through the bypass core portions 78, the magnetic flux shielding members 79 do not reduce or shield the magnetic flux passing through the magnetic path (reference is made to FIG. 2 and FIG. 4A).

On the other hand, when the temperatures of the bypass core portions 78 reach Curie points, the bypass core portions 78 lose the functions of inducing magnetic flux. In this manner, when the temperatures of the bypass core portions 78 reach the Curie points, the bypass core portions 78 do not enable bypass of magnetic flux. In other words, when the temperatures of the bypass core portions 78 reach the Curie points, the magnetic permeability of the bypass core portions 78 are reduced, the functions of inducing the magnetic flux of the bypass core portions 78 are lost and thereby the magnetic flux stops bypassing the magnetic flux shielding members 79.

When the temperatures of the bypass core portions 78 have reached the Curie points, magnetic flux that no longer bypasses through the bypass core portions 78 passes through the magnetic flux shielding members 79. The magnetic flux shielding members 79 generate magnetic flux in the direction opposite to the penetrating magnetic flux by the induced current generated in the magnetic flux shielding members 79 by penetration (passage) of the magnetic flux in the magnetic flux shielding members 79. The magnetic flux shielding member 79 reduce or shield the magnetic flux passing through the magnetic path by generating a magnetic flux in a direction that cancels the linkage magnetic flux (vertical penetrating flux) (reference is made to FIG. 4B).

The plurality of arch core portions 74 as a second core portion is disposed facing an outer peripheral surface of the heating rotary belt 93 with the center core portions 73 and the wire that configures the induction coil 71 sandwiching therebetween. The plurality of arch core portions 74 are separated from the center core portions 73 and the induction coil 71. The plurality of arch core portions 74 are integrally formed from the downstream side to the upstream side in the conveyance direction D1 of the sheet of paper T along the peripheral surface of the heating rotary belt 93 on an upper outer portion of the induction coil 71 and the center core portions 73, and extends in an arch configuration. Each of the arch core portions 74 includes a horizontal portion 742 and an inclined portion 743.

As illustrated in FIG. 2 and FIG. 3, the plurality of arch core portions 74 is formed in alignment with the center core portions 73 along the revolving direction R3 of the magnetic path at a predetermined position in the sheet width direction D2. The plurality of arch core portions 74 forms a magnetic path on the opposite side (outer side of the induction coil 71) to the heating rotary belt 93 in relation to the induction coil 71 in the revolving direction R3 of the magnetic path.

The plurality of arch core portions 74 is separated with each other by a predetermined distance in the sheet width direction D2. The plurality of arch core portions 74 forms a plurality of magnetic paths revolving in the revolving direction R3 and separated in the sheet width direction D2 with each other.

As illustrated in FIG. 2, the pair of side core portions 76 as a first core portion forms a magnetic path between the heating rotor 9*a* and the arch core portions 74 in the revolving direction R3 of the magnetic path. The pair of side core portions 76 is disposed in alignment with the plurality of arch core portions 74 in the revolving direction R3 of the magnetic path.

The pair of side core portions 76 is disposed in proximity to the outer peripheral edge 711B of the induction coil 71. The pair of side core portions 76 is separated from the outer peripheral surface of the heating rotary belt 93 by a predetermined distance without sandwiching the wire forming the induction coil 71 therebetween, and is disposed facing the outer peripheral surface of the heating rotary belt 93. The ends of the side core portions 76 near to the heating rotary belt 93 are disposed closer to the heating rotor 9*a* than the arch core portions 74 in proximity to the inner peripheral edge 711A of the induction coil 71.

The pair of side core portions 76 is formed in substantially a rectangular parallelepiped shape that is elongated with respect to the sheet width direction D2. The pair of side core portions 76 is formed in the sheet width direction D2 with substantially the same length as the maximum paper passing region 901.

Next, the operation of the printer 1 including the fixing unit 9 according to the present embodiment will be described. Firstly, a reception unit (not illustrated) of the printer 1 receives image formation instruction information generated based on the operation of an operation unit (not shown) disposed on an outer portion of the printer 1 for example, when the power source of the printer 1 is in the ON position.

Next, the printer 1 starts the printing operation.

When power supply to the drive control unit (not shown) commences, the pressing roller 9*b* is driven to rotate by the rotation drive unit (not shown). The heating rotary belt 9*a* is driven to rotate by the rotation of the pressing roller 9*b*.

Then, the fixing unit 9 commences a heat generation operation. In this manner, an alternating current is applied to the induction coil 71 from the induction heating circuit (not illustrated). The induction coil 71 generates a magnetic flux, thereby generating heat in the heating rotor 9*a*.

As illustrated in FIG. 2, the magnetic flux generated by the induction coil 71 is introduced into the heating rotor 9*a*. The magnetic flux generated in the induction coil 71 and introduced into the heating rotor 9*a* passes through the magnetic path that is formed by the heating rotor 9*a*, the side core portions 76, the arch core portions 74 and the center core portions 73.

In the present embodiment, as illustrated in FIG. 2 and FIG. 3, the center core portions 73 extends in the sheet width direction D2 in the minimum non-paper passing region 903*d*. The magnetic flux shielding members 79 is disposed in an inner portions of the center core portions 73. The magnetic flux shielding members 79 are substantially the same length in the sheet width direction D2 as the center core portions 73, and extend in the sheet width direction D2 in the minimum non-paper passing region 903*d*.

In the paper passing region of the sheet of paper T, the magnetic flux generated by the induction coil 71 is introduced into the heating rotor 9*a*, the side core portions 76 and the arch core portions 74 that form the magnetic path since the center core portions 73 are not provided. In the non-paper passing region of the sheet of paper T, as illustrated in FIG. 4A, the magnetic flux generated in the induction coil 71 is introduced into the bypass core portions 78 of the center core portions 73 to thereby bypass the magnetic flux shielding members 79.

An eddy current (induction current) is generated by electromagnetic induction in the heating rotor 9*a* due to variations in the direction and the intensity of the magnetic flux passing through the magnetic path. The eddy current passes through the heating rotor 9*a* in the paper passing region and the non-paper passing region to thereby generate Joule heat due to the electrical resistance of the heating rotor 9*a*.

Next, the rotation of the heating rotor 9*a* displaces the portion that is heated by electromagnetic induction heating (IH) in the heating rotor 9*a* in a sequential manner toward the fixing nip F formed by the heating rotor 9*a* and the pressing roller 9*b* of the fixing unit 9. The fixing unit 9 controls the induction heating circuit (not illustrated) so that temperature at the fixing nip F becomes a predetermined temperature.

The sheet of paper T with the toner image is introduced into the fixing nip F of the fixing unit 9. In this manner, the toner configuring the toner image transferred onto the sheet of paper T is melted in the fixing nip F to thereby fix the toner to the sheet of paper T.

Heat is taken from the heating rotor 9*a* by contact of the sheet of paper T with the outer peripheral surface of the heating rotor 9*a* in the paper passing region through which the sheet of paper T passes. On the other hand, the sheet of paper T does not make contact with the outer peripheral surface of the heating rotor 9*a* in the non-paper passing region through which the sheet of paper T does not pass. Consequently, the temperature of the heating rotor 9*a* may undergo an excessive increase. In particular, when continuous printing is executed using small-sized sheets of paper T, the range of the non-passing paper region is large, and the temperature of the heating rotor 9*a* tends to undergo an excessive increase in that large non-paper passing region.

In the present embodiment, when the center core portions 73, the arch core portions 47 and the temperatures of the side core portions 76 as described above reach the Curie points, the function of introducing magnetic flux is lost. That is to say, the center core portions 73, the arch core portions 47 and the side core portions 76 lose the function of introducing magnetic flux upon reaching the Curie points in the non-paper passing region.

In this manner, the magnetic flux generated by the induction coil 71 is no longer introduced into the center core portions 73, the arch core portions 47 and the side core portions 76. Consequently, the loop shape of the magnetic flux generated by the induction coil 71 is larger than when the center core portions 73, the arch core portions 47 and the side core portions 76 have the function of introducing magnetic flux, and the introduction of magnetic flux is stopped in an efficient manner. In this manner, the efficiency of generating heat in the heating rotor 9*a* is reduced in the non-paper passing region in which the temperature of the heating rotor 9*a* has increased. Therefore, in the non-paper passing region, excessive temperature increase in the heating rotor 9*a* is suppressed.

Furthermore, the magnetic flux shielding members 79 disposed in inner portions of the center core portions 73 are disposed in abutment with or proximity to the bypass core portions 78. When the bypass core portions 78 do not have the function of inducing magnetic flux, the magnetic flux shielding members 79 are disposed at a position of passage of at least a portion of the magnetic flux generated by the induction coil 71. When the temperatures of the bypass core portions 78 reach the Curie points, the function of inducing magnetic flux of the bypass core portions 78 are lost. When the temperatures of the bypass core portions 78 have reached the Curie points, there is a tendency for the magnetic flux that no longer bypasses through the bypass core portions 78 to pass through the magnetic flux shielding members 79 as illustrated in FIG. 4B.

When the temperature of the bypass core portions 78 in the non-paper passing region of the sheet of paper T of each size have reached the Curie points, there is a tendency for the magnetic flux generated by the induction coil 71 in the non-paper passing region to pass through the magnetic flux shielding members 79 disposed in inner portions of the center core portions 73. In this manner, the magnetic flux shielding members 79 generate a magnetic flux in the opposite direction to the penetrating magnetic flux due to the induction current resulting from penetration of the magnetic flux that is vertical to the surfaces of the magnetic flux shielding members 79. The magnetic flux shielding members 79 reduce or shield the magnetic flux that passes through the magnetic path by generating a magnetic flux in a direction that cancels the linkage magnetic flux (vertical penetrating flux). Consequently, only a portion of the magnetic flux that tends to pass through the magnetic flux shielding members 79 passes through the magnetic flux shielding members 79 (including the situation in which no flux passes).

In this manner, the magnetic flux shielding members 79 enable reduction or shielding of the penetrating magnetic flux when the temperatures of the center core portions 73 (bypass core portions) have reached the Curie points in the non-paper passing region. Therefore, the magnetic flux is subject to reduction or shielding by the magnetic flux shielding members 79 in the non-paper passing region in response to the respective sizes of the sheet of paper T. In this manner, in the non-paper passing region, further suppression of excessive temperature increase in the heating rotor 9*a* is enabled.

The following effects are enabled for example by the printer 1 according to the first embodiment. The printer 1 according to the first embodiment includes a heating rotor 9*a*, a pressure rotor 9*b*, an induction coil 71 that generates a magnetic flux to heat the heating rotor 9*a*, and a magnetic core portion 72 including bypass core portions 78 and magnetic flux shielding members 79. Curie points of the bypass core portions 78 are higher than the temperatures of the bypass core portions 78 when temperature of the heating rotor 9*a* has reached a fixing temperature for fixing of the transfer material T, and lower than the temperatures of the bypass core portions 78 when temperature of the heating rotor 9*a* has reached a heat-resistant temperature. The magnetic flux shielding members 79 are configured about the periphery of the bypass core portions 78 in close proximity or abutment with the bypass core portions 78.

As a result, when the temperatures of the bypass core portions 78 have not reached the Curie points, the bypass core portions 78 introduce magnetic flux generated by the induction coil 71 to thereby efficiently generate heat in the heating rotor 9*a*. On the other hand, when the temperatures of the bypass core portions 78 have reached the Curie points, the functions of introducing magnetic flux by the bypass core portions 78 are lost. In this manner, the magnetic flux shielding members 79 enable a reduction or shielding of the magnetic flux generated by the induction coil 71. As a result, further suppression of excessive temperature increase in the heating rotor 9*a* is enabled.

Furthermore, in the printer 1 according to the first embodiment, the magnetic flux shielding members 79 are disposed in inner portions of the center core portions 73. Consequently, an increase in the size of the fixing unit 9 can be suppressed.

Furthermore, the ends of the center core portions 73 near to the heating rotary belt 93 are disposed at positions in proximity to the heating rotor 9*a*. The center core portions 73 have a small heat capacity in comparison with the arch core portions 74. The temperatures of the center core portions 73 tend to track the temperature of the heating rotor 9*a*. In this manner, when the temperature of the heating rotor 9*a* rises, the temperatures of the center core portions 73 track the temperature increase in the heating rotor 9*a* and efficiently rises to the Curie points. Therefore, efficient suppression of excessive temperature increase in the heating rotor 9*a* is enabled.

The magnetic flux shielding members 79 in the printer 1 according to the first embodiment are disposed in the inner portions of the center core portions 73 at positions corresponding to the minimum non-paper passing region 903*d*. As a result, efficient suppression of excessive temperature increase in the heating rotor 9*a* is enabled in the non-paper passing region for each size of the sheet of paper T.

The Curie point of the magnetic core portion 72 in the printer 1 according to the first embodiment is set to be higher than or equal to the temperature of the magnetic core portion 72 when the temperature of the heating rotary belt 93 has reached the fixing temperature in the fixing unit 9. When the Curie points of the center core portions 73, the arch core portions 74 and the side core portions 76 are higher than or equal to the fixing temperature, during warm-up, the temperatures of the center core portions 73, the arch core portions 74 and the side core portions 76 do not reach the Curie points until the temperature of the heating rotor 9*a* reaches the fixing temperature. As a result, rapid increase in the temperature of the heating rotor 9*a* is enabled. Therefore, efficient increase in the temperature of the heating rotor 9*a* to the fixing temperature is enabled.

Next, a second embodiment will be described with reference to the figures as a further embodiment of the printer 1 according to the present disclosure. In the description of the second embodiment, the same constituent elements as those in the first embodiment are denoted by the same reference numerals, and description will not be repeated.

Figure 5:
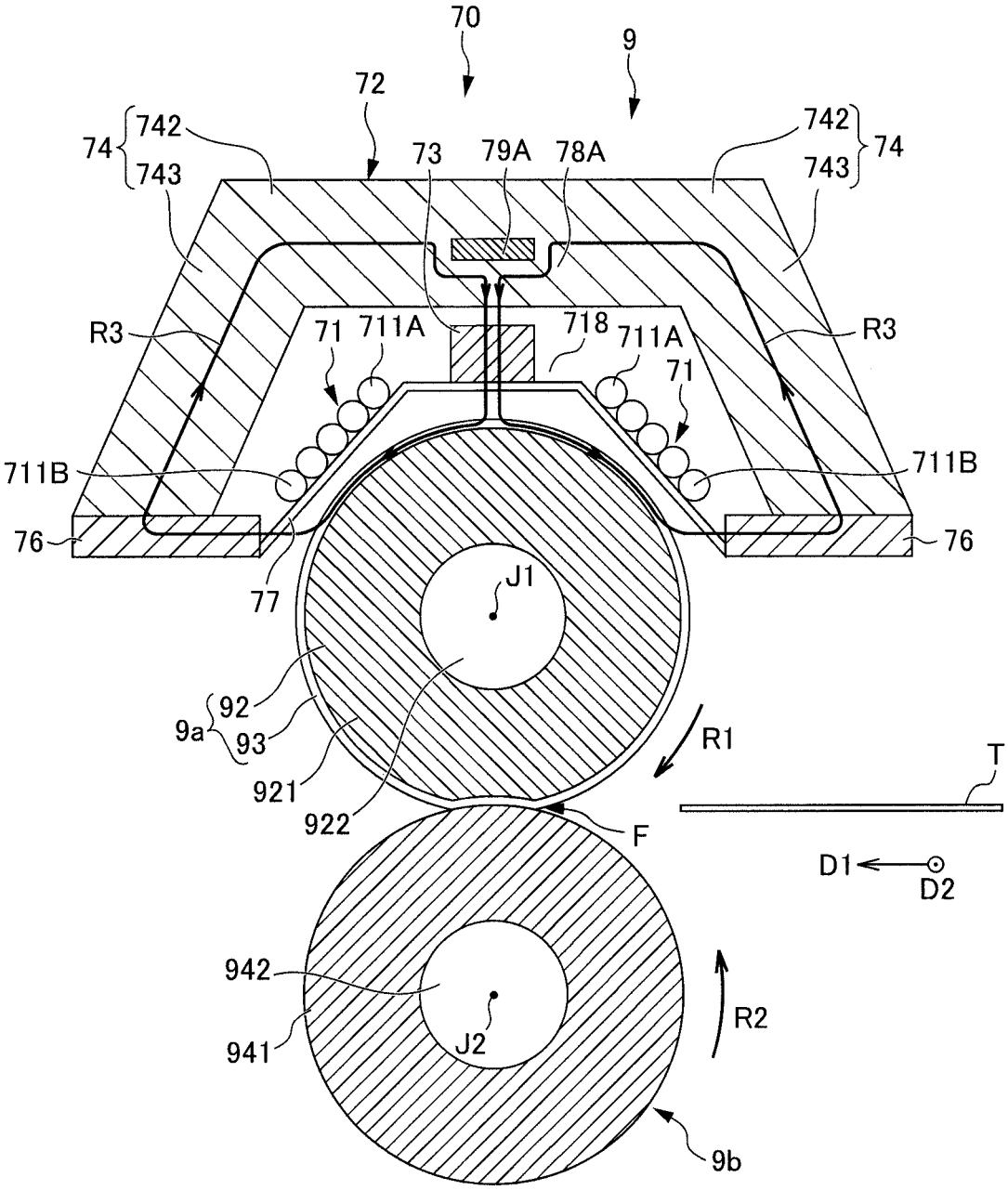
FIG. 5 is a sectional view illustrating the respective constituent elements of a fixing unit in a printer according to a second embodiment.
Figure 6:
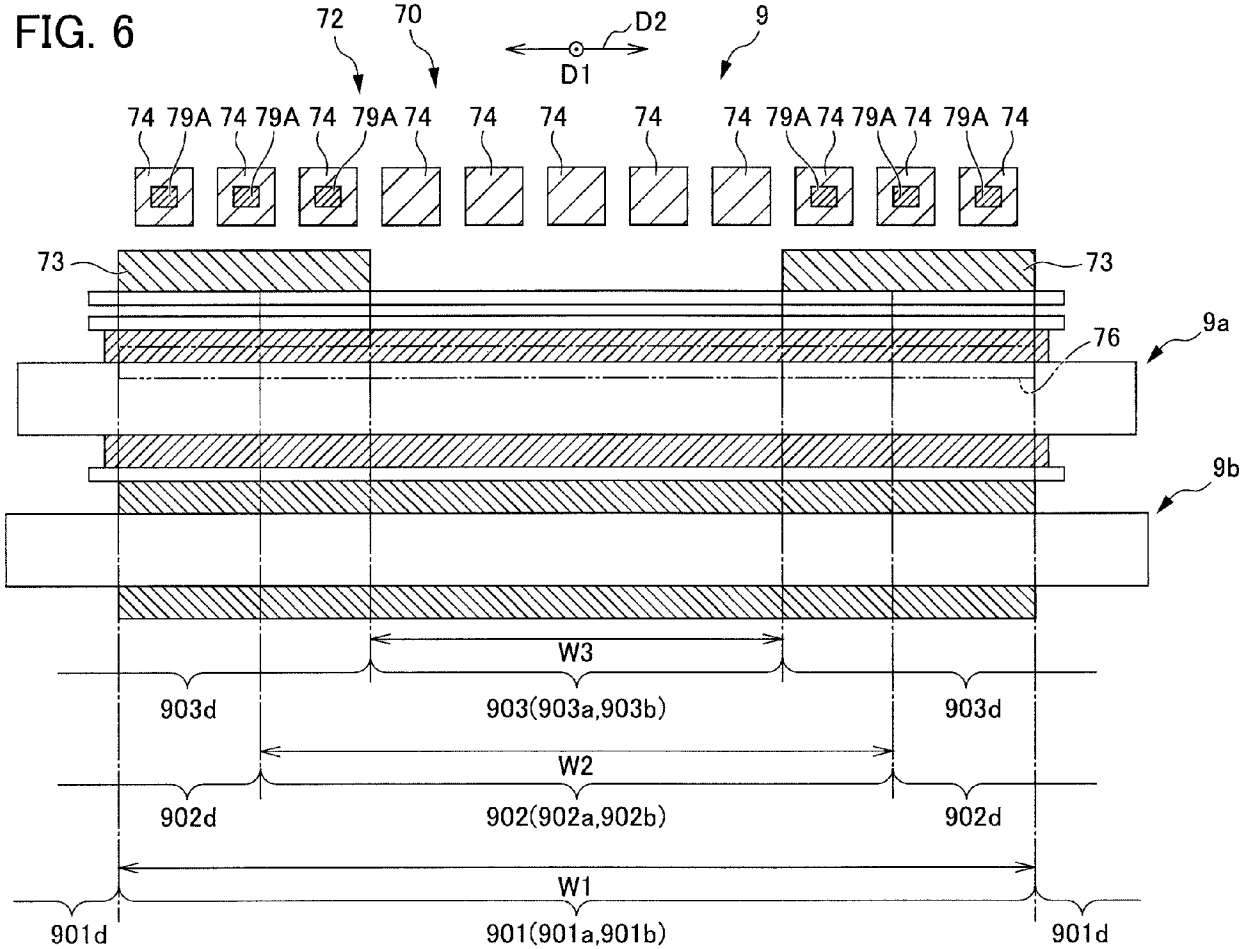
FIG. 6 is a view of the fixing unit illustrated in FIG. 5 as seen from the conveyance direction of a sheet of paper.
Figure 7A:
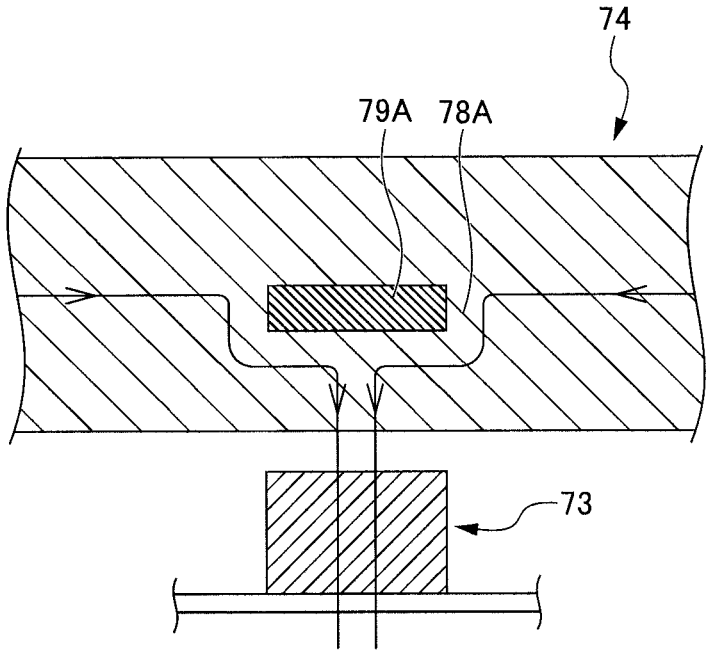
FIG. 7A is a sectional view illustrating the magnetic flux that passes through arch core portions when temperatures of the arch core portions in the second embodiment have not reached Curie points.
Figure 7B:
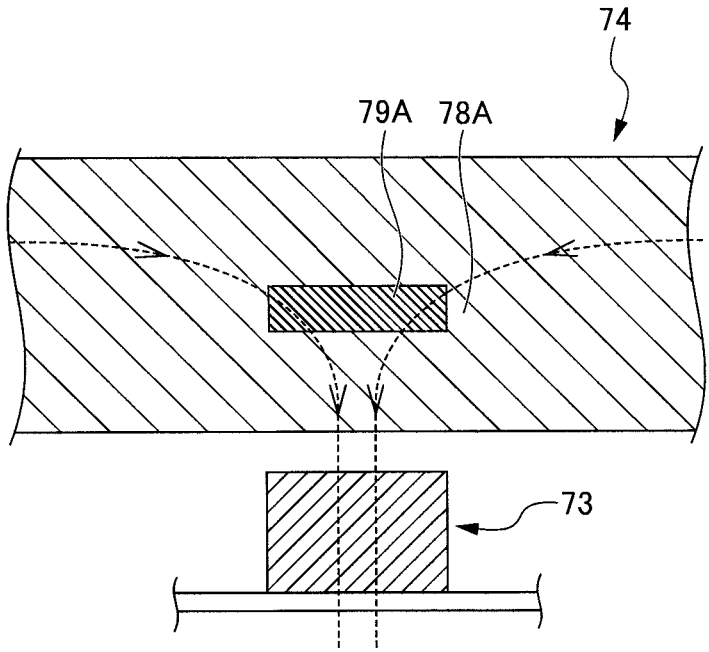
FIG. 7B is a sectional view illustrating the magnetic flux that passes through the arch core portions when temperatures of the arch core portions in the second embodiment have reached the Curie points.

FIG. 5 is a sectional view illustrating the respective constituent elements in a fixing unit 9 in the printer 1 according to the second embodiment. FIG. 6 is a view of the fixing unit 9 illustrated in FIG. 5 as seen from the conveyance direction D1 of a sheet of paper T. FIG. 7A is a sectional view illustrating the magnetic flux that passes through the arch core portions 74 when the temperatures of the arch core portions 74 in the second embodiment have not reached Curie points. FIG. 7B is a sectional view illustrating the magnetic flux that passes through the arch core portions 74 when the temperatures of the arch core portions 74 in the second embodiment have reached the Curie points.

The printer 1 according to the second embodiment mainly differs from the first embodiment in relation to the point that a magnetic flux shielding members 79A are disposed in an inner portions of the arch core portions 74 as second core portions and the point that bypass core portions 78A are provided in the inner portions of the arch core portions 74, in substitution for the disposition of the magnetic flux shielding members 79 in an inner portions of the center core portions 73 and the disposition of the bypass core portions 78 in the inner portions of the center core portions 73.

As illustrated in FIG. 5 and FIG. 6, the bypass core portions 78A are disposed above the heating rotor 9*a* and on the opposite side to the heating rotor 9*a* relative to the center core portions 73. The magnetic flux shielding members 79A are disposed in proximity to or abutment with the bypass core portions 78A in the inner portions of the arch core portions 74. The magnetic flux shielding members 79A are disposed about the periphery of the bypass core portions 78A described below on inner portions of the arch core portions 74. When the bypass core portions 78A do not have the function of inducing magnetic flux, the magnetic flux shielding members 79A are disposed at positions of passage of at least a portion of the magnetic flux generated by the induction coil 71.

The magnetic flux shielding members 79A are formed as rectangular parallelepiped shapes. A plurality of magnetic flux shielding members 79A is provided corresponding to the plurality of arch core portions 74. The plurality of magnetic flux, shielding members 79A is disposed in inner portions of the plurality of arch core portions 74. The magnetic flux shielding members 79A are disposed along the sheet width direction D2 in the minimum non-paper passing region 903*d*.

As illustrated in FIG. 7A and FIG. 7B, the arch core portions 74 include bypass core portions 78A. The bypass core portions 78A are the portion on the outer periphery of the magnetic flux shielding members 79A in the arch core portions 74. In other words, the bypass core portions 78A are portions where ferromagnetic materials continue to avoid the magnetic flux shielding members 79A on inner portions of the arch core portions 74.

When the temperatures of the bypass core portions 78A have not reached the Curie points, the magnetic flux generated by the induction coil 71 passes through the bypass core portions 78A as a result of the function of inducing the magnetic flux to the bypass core portions 78A as illustrated in FIG. 7A. As a result, the heating rotor 9*a* can be heated to a required temperature.

When the temperatures of the bypass core portions 78A have reached the Curie points, the functions of inducing the magnetic flux to the bypass core portions 78A are lost due to the reductions in the magnetic permeability of the bypass core portions 78A as illustrated in FIG. 7B. In this manner, the magnetic flux generated by the induction coil 71 no longer bypasses the magnetic flux shielding members 79A. When the temperatures of the bypass core portions 78A have reached the Curie points, the magnetic flux that no longer bypasses through the bypass core portions 78A passes into the magnetic flux shielding members 79A. Therefore, the magnetic flux shielding members 79A reduce or shield the penetrating magnetic flux. In this manner, in the non-paper passing region, suppression of excessive increase in the temperature of the heating rotor 9*a* is enabled. In this manner, the printer 1 according to the second embodiment enables the same effect as the first embodiment.

Next, a third embodiment will be described with reference to the figures as a further embodiment of the printer 1 according to the present disclosure. In the description of the third embodiment, the same constituent elements as those in the first embodiment are denoted by the same reference numerals, and description will not be repeated.

Figure 8:
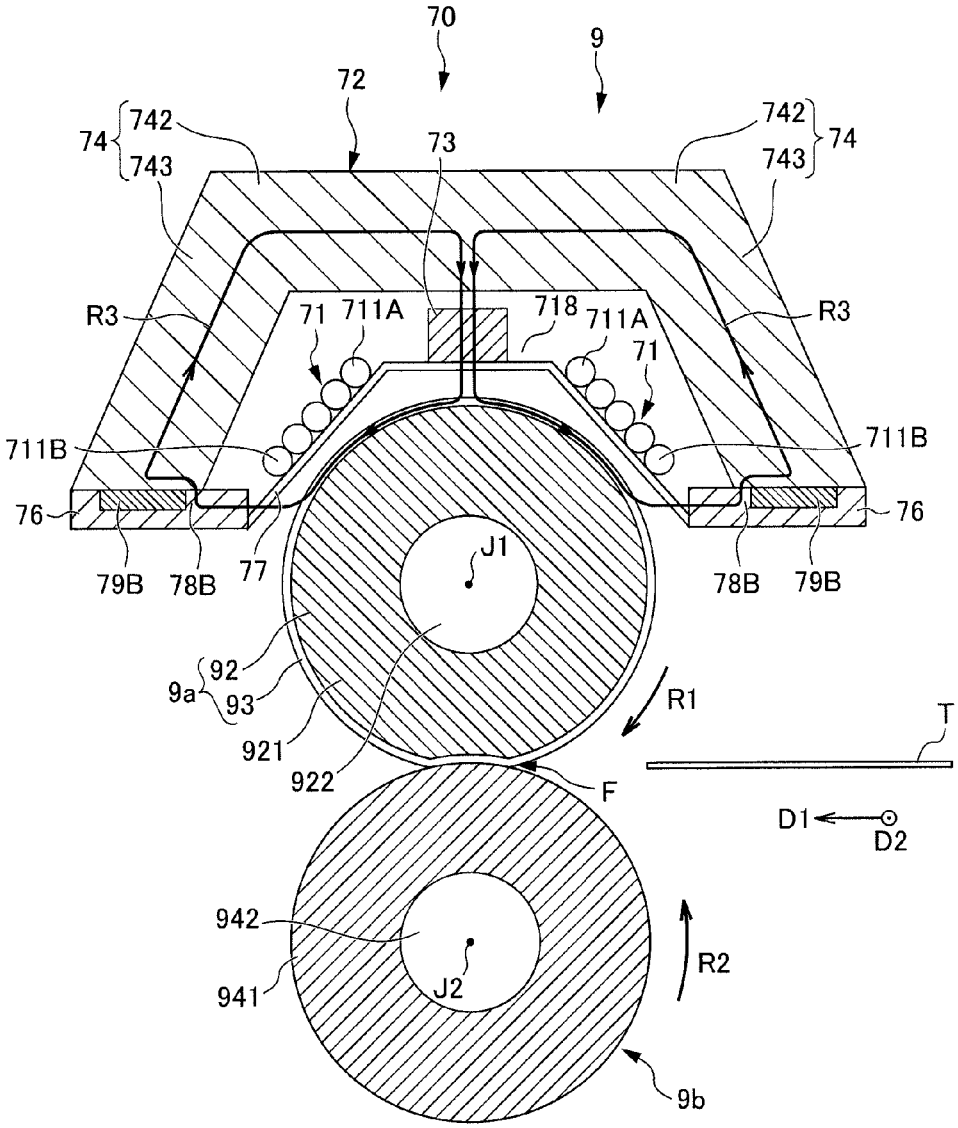
FIG. 8 is a sectional view illustrating the respective constituent elements in a fixing unit in a printer according to a third embodiment.
Figure 9A:
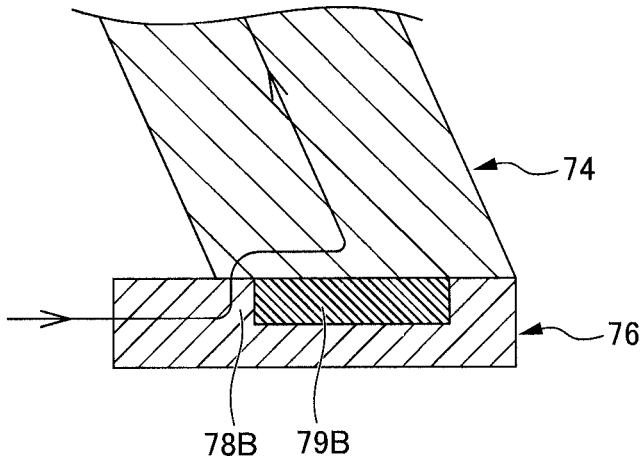
FIG. 9A is a sectional view illustrating the magnetic flux that passes through side core portions when temperatures of the side core portions in the third embodiment have not reached Curie points.
Figure 9B:
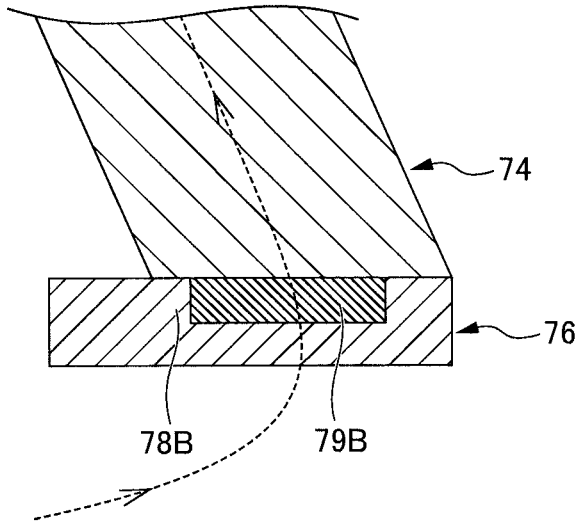
FIG. 9B is a sectional view illustrating the magnetic flux that passes through the side core portions when temperatures of the side core portions in the third embodiment have reached the Curie points.

FIG. 8 is a sectional view illustrating the respective constituent elements in a fixing unit 9 in the printer 1 according to a third embodiment. FIG. 9A is a sectional view illustrating the magnetic flux that passes through the side core portions 76 when the temperatures of the side core portions 76 in the third embodiment have not reached Curie points. FIG. 9B is a sectional view illustrating the magnetic flux that passes through the side core portions 76 when the temperatures of the side core portions 76 in the second embodiment have reached the Curie points.

The printer 1 according to the third embodiment mainly differs from the first embodiment in relation to the point that magnetic flux shielding members 79B are disposed in inner portions of the side core portions 76 as first core portions and the point that bypass core portions 78B are provided in the inner portions of the side core portions 76, in substitution for the disposition of the magnetic flux shielding members 79 in inner portions of the center core portions 73 and the disposition of the bypass core portions 78 in the inner portion of the center core portions 73.

As illustrated in FIG. 8, the magnetic flux shielding members 79B are disposed in proximity to or abutment with the bypass core portions 78B in the inner portion of the side core portions 76. The magnetic flux shielding members 79B are disposed about the periphery of the bypass core portions 78B described below in the inner portions of the side core portions 76. When the bypass core portions 78B do not have the functions of inducing magnetic flux, the magnetic flux shielding members 79B is disposed at positions of passage of at least a portion of the magnetic flux generated by the induction coil 71.

The magnetic flux shielding members 79B are formed as rectangular parallelepiped shapes. A pair of the magnetic flux shielding members 79B is provided on the upstream and the downstream side in the conveyance direction D1 of the sheet of paper T to sandwich the heating rotor 9*a* corresponding to the pair of side core portions 76. The magnetic flux shielding members 79B are disposed along the sheet width direction D2 in the minimum non-paper passing region 903*d*.

The magnetic flux shielding members 79B are disposed on upper portions of the side core portions 76. The upper surfaces of the magnetic flux shielding members 79B abut on a lower surface of the arch core portions 74. The magnetic flux shielding members 79B are disposed so that the portion of the side core portions 76 near to the heating rotor 9*a* form the bypass core portions 78B.

As illustrated in FIG. 9A and FIG. 9B, the bypass core portions 78B are formed in the side core portions 76. The bypass core portions 78B are portions of the periphery of the magnetic flux shielding members 79B on an outer sides of the magnetic flux shielding members 79B at the heating rotor 9*a* in the side core portions 76. In other words, the bypass core portions 78B are portions where ferromagnetic materials continue to avoid the magnetic flux shielding members 79B in the inner portions of the side core portions 76.

When the temperatures of the bypass core portions 78B do not reach Curie points, the magnetic flux generated by the induction coil 71 passes through the bypass core portions 78B as a result of the function of introducing the magnetic flux of the bypass core portions 78B as illustrated in FIG. 9A. In this manner, the heating rotor 9*a* can be heated to a predetermined temperature.

When the temperatures of the bypass core portions 78B have reached the Curie points, the functions of introducing the magnetic flux of the bypass core portions 78B are lost as illustrated in FIG. 9B. Therefore, the magnetic flux generated by the induction coil 71 no longer bypasses the magnetic flux shielding members 79B. As a result, the magnetic flux that no longer bypasses through the bypass core portions 78B passes into the magnetic flux shielding members 79B. Therefore, the magnetic flux shielding members 79B reduce or shield the penetrating magnetic flux. As a result, in the non-paper passing region, suppression of excessive increase in the temperature of the heating rotor 9*a* is enabled. Therefore, the printer 1 according to the third embodiment enables the same effect as the first embodiment.

Figure 10A:
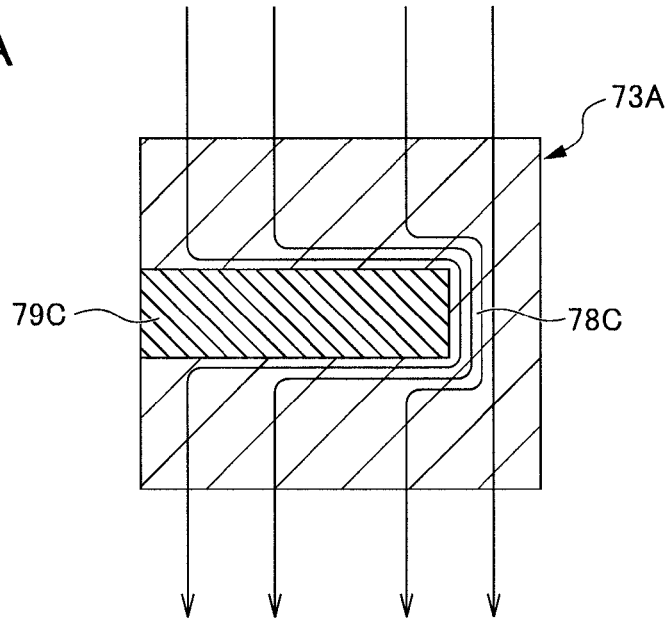
FIG. 10A is a sectional view illustrating the magnetic flux that passes through the center core portions when temperatures of the center core portions in a first modified embodiment have not reached Curie points.
Figure 10B:
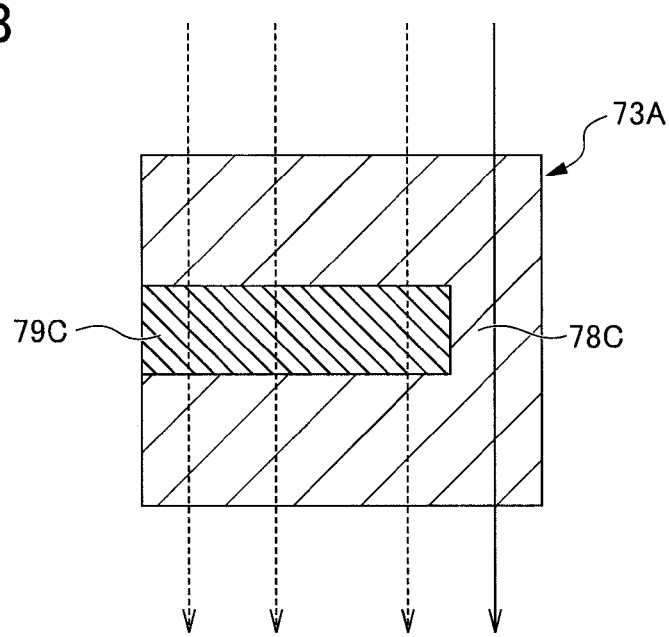
FIG. 10B is a sectional view illustrating the magnetic flux that passes through the center core portions when temperatures of the center core portions in a first modified embodiment have reached the Curie points.
Figure 11A:
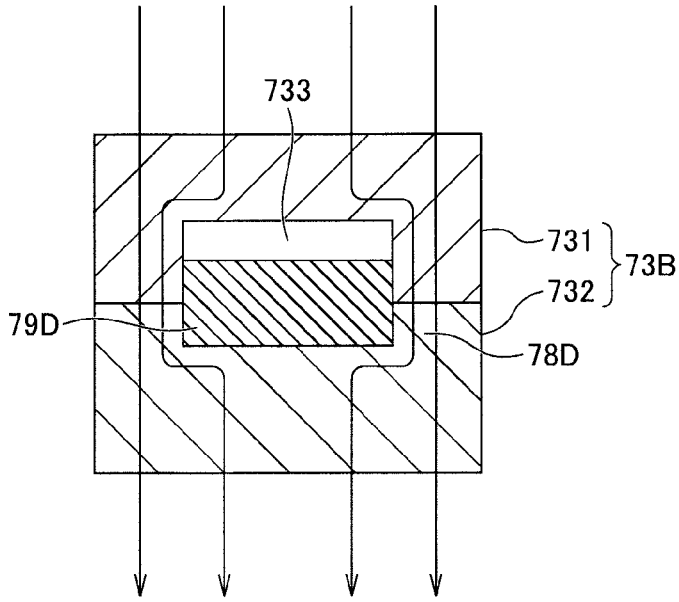
FIG. 11A is a sectional view illustrating the magnetic flux that passes through the center core portions when temperatures of the center core portions in a second modified embodiment have not reached Curie points.
Figure 11B:
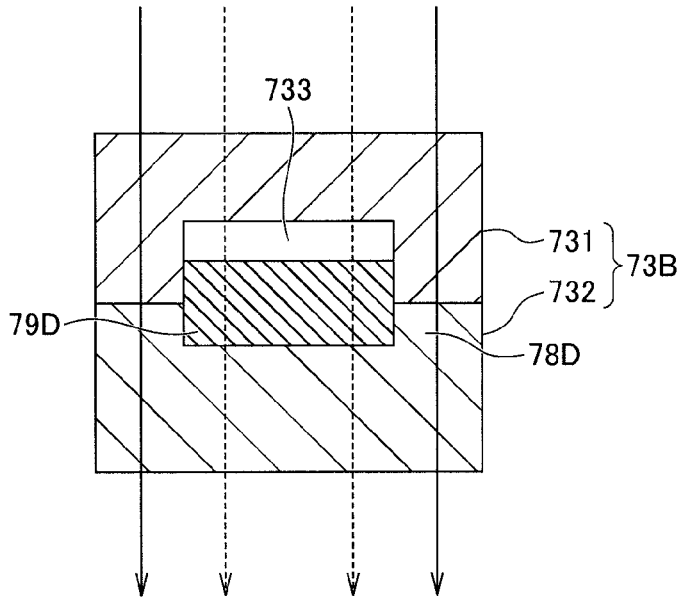
FIG. 11B is a sectional view illustrating the magnetic flux that passes through the center core portions when temperatures of the center core portions in a second modified embodiment have reached the Curie points.

Although the preferred embodiments have been described above, the present disclosure is not limited to the above embodiments and may be executed in various aspects. For example, the center core portions 73 and the magnetic flux shielding members 79 in the first embodiment above may be configured as illustrated in a first modified embodiment in FIG. 10A and FIG. 10B or as illustrated in a second modified embodiment in FIG. 11A and FIG. 11B. FIG. 10A is a sectional view illustrating the magnetic flux that passes through the center core portions 73A when the temperatures of the center core portions 73A in a first modified embodiment have not reached Curie points. FIG. 10B is a sectional view illustrating the magnetic flux that passes through the center core portions 73A when the temperatures of the center core portions 73A in the first modified embodiment have reached the Curie points. FIG. 11A is a sectional view illustrating the magnetic flux that passes through the center core portions 73B when the temperatures of the center core portions 73B in a second modified embodiment have not reached Curie points. FIG. 11B is a sectional view illustrating the magnetic flux that passes through the center core portions 73B the temperatures of when the center core portions 73B in the second modified embodiment have reached the Curie points.

As illustrated in the first modified embodiment in FIG. 10A and FIG. 10B, in comparison with the first embodiment, magnetic flux shielding members 79C are disposed near to the downstream end in the conveyance direction D1 of the sheet of paper T in inner portions of the center core portions 73A. Bypass core portions 78C are formed on peripheral portions of the magnetic flux shielding members 79C in the center core portions 73A. The bypass core portions 78C are portions where ferromagnetic materials continue to avoid the magnetic flux shielding members 79C.

As illustrated in the second modified embodiment in FIG. 11A and FIG. 11B, the center core portions 73B are divided into two members being upper members 731 and lower members 732, and magnetic flux shielding members 79D are sandwiched by the upper members 731 and the lower members 732. In this case, manufacture is facilitated since the magnetic flux shielding members 79D can be sandwiched by dividing the center core portions 73B. Spaces 733 may be provided between the center core portions 73B and the magnetic flux shielding members 79D in inner portions of the center core portions 73B. A bypass core portions 78D are formed on peripheries of the spaces 733 and the magnetic flux shielding members 79D in the center core portions 73B. The bypass core portions 78D are portions where ferromagnetic materials continue to avoid the magnetic flux shielding members 79D. When the temperatures of the bypass core portions 78D do not reach the Curie points, the bypass core portions 78D are the portions that introduce magnetic flux generated by the induction coil 71 to thereby bypass the magnetic flux shielding members 79D and the spaces 733.

In the embodiment described above, although the magnetic flux shielding members 79 was disposed at positions corresponding to the minimum non-paper passing region 903*d* in the magnetic core portions 72, the disclosure is not limited in this regard. For example, the magnetic flux shielding members 79 may be disposed at positions corresponding to the maximum non-paper passing regions 901*d* in the magnetic core portions 72, or disposed across the entire paper passing regions and non-paper passing regions.

There is no particular limitation in relation to the type of image forming apparatus according to the present disclosure, and in addition to a printer, it includes a copying machine, facsimile, or a multifunction peripheral of such components. The sheet-shaped transfer material is not limited to paper, and for example, may include film sheet.

The invention claimed is:

1. A fixing unit comprising: a heating rotor, a pressure rotor that is disposed facing the heating rotor and that forms a fixing nip with the heating rotor, an induction coil disposed along an outer surface at a predetermined distance from the outer surface of the heating rotor to thereby generate a magnetic flux to heat the heating rotor, and a magnetic core portion including a bypass core portion and a magnetic flux shielding member, wherein a Curie point of the bypass core portion is higher than the temperature of the bypass core portion when the temperature of the heating rotor has reached a fixing temperature for fixing of the transfer material, and lower than the temperature of the bypass core portion when the temperature of the heating rotor has reached a heat-resistant temperature, and wherein the magnetic flux shielding member is configured about the periphery of the bypass core portion in close proximity or abutment with the bypass core portion; wherein the magnetic core portion includes a first core portion separated from the outer peripheral surface of the heating rotor by a predetermined distance without sandwiching the induction coil therebetween, and facing the outer surface of the heating rotor, and a second core portion facing the outer surface of the heating rotor and sandwiching the induction coil with the heating rotor, and wherein the first core portion is disposed more in proximity to the heating rotor than the second core portion, and wherein the magnetic flux shielding member is disposed in an inner portion of the first core portion.

2. The fixing unit according to claim 1, comprising a first region that is formed on an outer surface of the heating rotor, and is a region through which the transfer material passes when the transfer material is conveyed to the fixing nip, and a second region that is formed on an outer surface of the heating rotor, and is a region on an outer side in an orthogonal direction which is a direction orthogonal to the conveyance direction of the transfer material seen from the first region, and wherein the magnetic flux shielding member is disposed in a position corresponding to the second region in the magnetic core portion.

3. A fixing unit comprising: a heating rotor, a pressure rotor that is disposed facing the heating rotor and that forms a fixing nip with the heating rotor, an induction coil disposed along an outer surface at a predetermined distance from the outer surface of the heating rotor to thereby generate a magnetic flux to heat the heating rotor, and a magnetic core portion including a bypass core portion and a magnetic flux shielding member, wherein a Curie point of the bypass core portion is higher than the temperature of the bypass core portion when the temperature of the heating rotor has reached a fixing temperature for fixing of the transfer material, and lower than the temperature of the bypass core portion when the temperature of the heating rotor has reached a heat-resistant temperature, and wherein the magnetic flux shielding member is configured about the periphery of the bypass core portion in close proximity or abutment with the bypass core portion; wherein the magnetic core portion includes a first core portion separated from the outer surface of the heating rotor by a predetermined distance without sandwiching the induction coil therebetween, and facing the outer surface of the heating rotor, and a second core portion facing the outer surface of the heating rotor and sandwiching the induction coil and the first core portion with the heating rotor, and wherein the magnetic flux shielding member is disposed in an inner portion of the second core portion.

4. The fixing unit according to claim 3, comprising a first region that is formed on an outer surface of the heating rotor, and is a region through which the transfer material passes when the transfer material is conveyed to the fixing nip, and a second region that is formed on an outer surface of the heating rotor, and is a region on an outer side in an orthogonal direction which is a direction orthogonal to the conveyance direction of the transfer material seen from the first region, and wherein the magnetic flux shielding member is disposed in a position corresponding to the second region in the magnetic core portion.

5. An image forming apparatus comprising an image carrier for forming an electrostatic image on a surface thereof, a developing unit for developing the electrostatic image formed on the image carrier as a toner image, and a transfer unit for transferrin the toner image formed on the image carrier onto a transfer material, and a fixing unit, wherein the fixing unit includes a heating rotor, a pressure rotor that is disposed facing the heating rotor and that forms a fixing nip with the heating rotor, an induction coil disposed along an outer surface at a predetermined distance from the outer surface of the heating rotor to thereby generate a magnetic flux to heat the heating rotor, and a magnetic core portion including a bypass core portion and a magnetic flux shielding member, wherein the fixing unit is configured so that a Curie point of the bypass core portion is higher than the temperature of the bypass core portion when the temperature of the heating rotor has reached a fixing temperature for fixing of the transfer material, and lower than the temperature of the bypass core portion when the temperature of the heating rotor has reached a heat-resistant temperature, and wherein the magnetic flux shielding member is configured about the periphery of the bypass core portion in close proximity or abutment with the bypass core portion; wherein the magnetic core portion includes a first core portion separated from the outer peripheral surface of the heating rotor by a predetermined distance without sandwiching the induction coil therebetween, and facing the outer surface of the heating rotor, and a second core portion facing the outer surface of the heating rotor and sandwiching the induction coil with the heating rotor, and wherein the first core portion is disposed more in proximity to the heating rotor than the second core portion, and wherein the magnetic flux shielding member is disposed in an inner portion of the first core portion.

6. The imaging forming apparatus according to claim 5, comprising a first region that is formed on an outer surface of the heating rotor, and is a region through which the transfer material passes when the transfer material is conveyed to the fixing nip, and a second region that is formed on an outer surface of the heating rotor, and is a region on an outer side in an orthogonal direction which is a direction orthogonal to the conveyance direction of the transfer material seen from the first region, and wherein the magnetic flux shielding member is disposed in a position corresponding to the second region in the magnetic core portion.

7. An image forming apparatus comprising and image carrier for forming an electrostatic image on a surface thereof, a developing unit for developing the electrostatic image formed on the image carrier as a toner image, and a transfer unit for transferring the toner image formed on the image carrier onto a transfer material, and a fixing unit, wherein the fixing unit includes a heating rotor, a pressure rotor that is disposed facing the heating rotor and that forms a fixing nip with the heating rotor, an induction coil disposed along an outer surface at a predetermined distance from the outer surface of the heating rotor to thereby generate a magnetic flux to heat the heating rotor, and a magnetic core portion including a bypass core portion and a magnetic flux shielding member wherein the fixing unit is configured so that a Curie point of the bypass core portion is higher than the temperature of the bypass core portion when the temperature of the heating rotor has reached a fixing temperature for fixing of the transfer material, and lower than the temperature of the bypass core portion when the temperature of the heating rotor has reached a heat-resistant temperature, and wherein the magnetic flux shielding member is configured about the periphery of the bypass core portion in close proximity or abutment with the bypass core portion, wherein the magnetic core portion includes a first core portion separated from the outer surface of the heating rotor by only a predetermined distance without sandwiching the induction coil therebetween, and facing the outer surface of the heating rotor, and a second core portion facing the outer surface of the heating rotor and sandwiching the induction coil and the first core portion with the heating rotor, and wherein the magnetic flux shielding member is disposed in an inner portion of the second core portion.

8. The imaging forming apparatus according to claim 7, comprising a first region that is formed on an outer surface of the heating rotor, and is a region through which the transfer material passes when the transfer material is conveyed to the fixing nip, and a second region that is formed on an outer surface of the heating rotor, and is a region on an outer side in an orthogonal direction which is a direction orthogonal to the conveyance direction of the transfer material seen from the first region, and wherein the magnetic flux shielding member is disposed in a position corresponding to the second region in the magnetic core portion.

* * * * *